US005939652A

United States Patent [19]

Jones

[11] Patent Number: 5,939,652

[45] Date of Patent: Aug. 17, 1999

[54] TONE ENHANCEMENT DEVICE FOR A MUSICAL INSTRUMENT

[75] Inventor: Robert L. Jones, 14 Green Glen Ter., East Haven, Conn. 06512

[73] Assignee: Robert L. Jones, East Haven, Conn.

[21] Appl. No.: 08/751,122

[22] Filed: Nov. 15, 1996

[51] Int. Cl.[6] ..... G10D 3/02

[52] U.S. Cl. ..... 84/294; 84/453; 84/327; 84/278

[58] Field of Search ..... 84/453, 327, 280, 84/278, 294, 296, 287, 273

[56] References Cited

U.S. PATENT DOCUMENTS

| | | | |
|---|---|---|---|
| 2,660,912 | 12/1953 | Prescott . | |
| 3,371,570 | 3/1968 | Lester . | |
| 3,956,963 | 5/1976 | Milton | 84/296 |
| 4,170,162 | 10/1979 | Casavant . | |
| 4,192,214 | 3/1980 | Mixon, Jr. et al. . | |
| 4,213,369 | 7/1980 | Swartwout . | |
| 4,247,029 | 1/1981 | Levin . | |
| 4,334,455 | 6/1982 | Beecher . | |
| 4,407,181 | 10/1983 | Thomas . | |
| 4,467,692 | 8/1984 | Egan . | |
| 5,191,160 | 3/1993 | Barnett . | |

FOREIGN PATENT DOCUMENTS 38 05 396-A 9/1988 Germany .

*Primary Examiner*—William M. Shoop, Jr.
*Assistant Examiner*—Kim Lockett
*Attorney, Agent, or Firm*—Ohlandt, Greeley, Ruggiero & Perle

[57] ABSTRACT

A device for a stringed instrument to maintain the tone emitted from the instrument which is otherwise dampened by the user's body. The device includes a plate having an outer contour approximately matching that of a back surface of the instrument and at least one space. The plate remains in place against the back surface of the instrument while the instrument is being played. The device may also include a plurality of pads that space the plate from the back surface of the instrument.

21 Claims, 4 Drawing Sheets

TONE ENHANCEMENT DEVICE FOR A MUSICAL INSTRUMENT

FIELD OF THE INVENTION

The present invention relates generally to an accessory for stringed instruments. More particularly, the present invention relates to a tone enhancement device for attachment to the back of stringed instruments, such as mandolins, guitars, banjos and the like, to prevent muffling of the instrument's sound or tone otherwise caused by the instrument's back contacting the player's body.

BACKGROUND OF THE INVENTION

A wide variety of stringed instruments, such as, for example, mandolins, guitars and banjos, are played while being held against the player's body, and supported by a strap about the player's neck or shoulder.

This playing position, while providing greater mobility and versatility than that provided by an instrument mounted in a stand, has certain drawbacks. One such drawback is the tendency of the player's body and clothing to muffle the desired sound normally produced by the instrument. When the back of the instrument is close to, enclosed by, or situated directly against the player's clothes or body, the vibrations or sound produced when the instrument is played are dampened. Also, the reverberation of the sound waves can be dampened. Such effects cause the tone produced by the instrument to be somewhat dampened or flat and muffled.

Attempts have been made to remedy this problem. However, such attempts have produced complicated devices that are difficult to mount or that can dismount unexpectedly. Also, such attempts can damage the finish of the instruments. In addition, most such devices are utilitarian in appearance and detract from the overall visual effect of the instrument. Furthermore, some such devices provide only limited improvements in tone quality, and limit the positions in which the instrument can be played.

One such known device consists of a metal semicircular guard that has a series of metal legs spaced around the semicircle forming the shape of a sunrise. The base line of the semicircle or sunrise is extended approximately 1¼ inch on each side beyond the intersecting point of the semicircle to the base line. The base line extensions are bent at a 90 degree right angle to form two permanent mounting tips.

A curved 4½ inch metal rod is welded along one side of the curved metal frame. One tip lies close to the base line. The other end of the welded rod is bent at a 90 degree angle forming the third mounting tip, which is flexible. When the tip is strummed, a slight vibration is produced. Rubber tubing is placed over the exposed end of each of the three mounting tips.

This guard has many limitations. The guard covers only one-half of the instrument back, thus allowing contact between the player's body and the other half of the instrument, so that tone quality and sound volume are dampened. This guard also limits the positions in which the instrument can be held, and these positions require the player to extend the player's arms beyond the normal playing position. Also, the metal rod out of which the guard is fashioned can easily wear the rubber tubing thin, and scratch, gouge or pierce the instrument, and may cut the player's hands. The rubber can also deteriorate and leave a residue or deposit on the finish of the instrument that is difficult to remove without harming the finish.

Furthermore, the third, or spring-tension, mounting arm can rapidly lose its resiliency in use, causing the guard to fall off of the instrument. It is also difficult to store an instrument with this guard attached. In addition, the guard is only minimally adjustable to fit different styles of instruments.

SUMMARY OF THE INVENTION

Accordingly, it is an object of the present invention to provide a device for use with a stringed instrument so that the instrument can be played against the player's clothes or body without dampening the vibrations and reverberations of the sound waves.

It is a further object of the present invention to provide such a device that is economical to manufacture, attractive in design, adapted to fit a range of instrument types, easy to mount, and safe for the finish of the instrument and the player.

Accordingly, the present invention discloses a device that prevents abatement of a tone from a stringed instrument, that includes a single substrate having an outer contour approximately matching that of a back surface of the instrument, and at least one relatively large aperture therein. There is also provided means for securing the substrate to the back surface of the instrument. In a more preferred embodiment, the device includes a single substrate having an outer contour or periphery approximately matching the contour of a back surface of the instrument, at least one bar integral with and internal to the contour, the at least one bar defining at least two apertures within the contour, and straps for attaching the device to the instrument.

DESCRIPTION OF THE PREFERRED EMBODIMENTS

Figure 1:
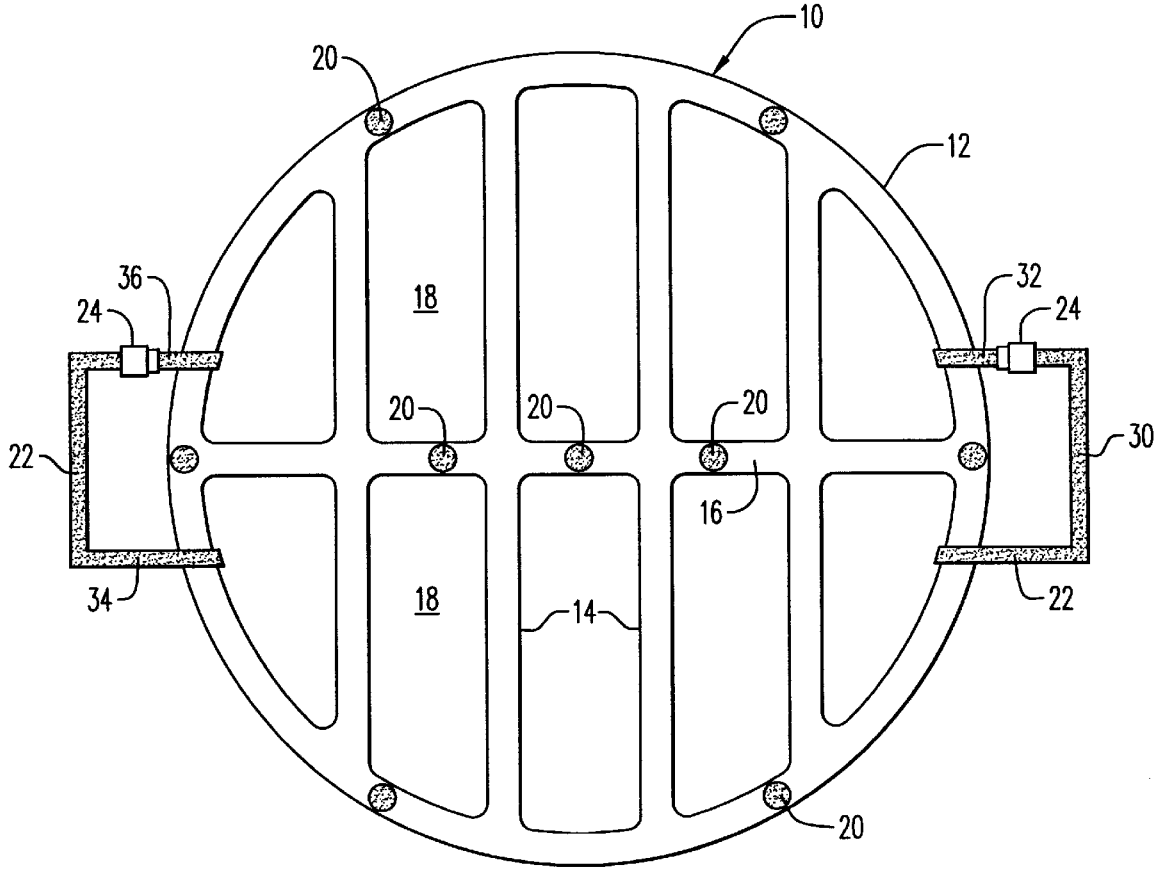
FIG. 1 is a front view of a first embodiment of the present invention.
Figure 2:
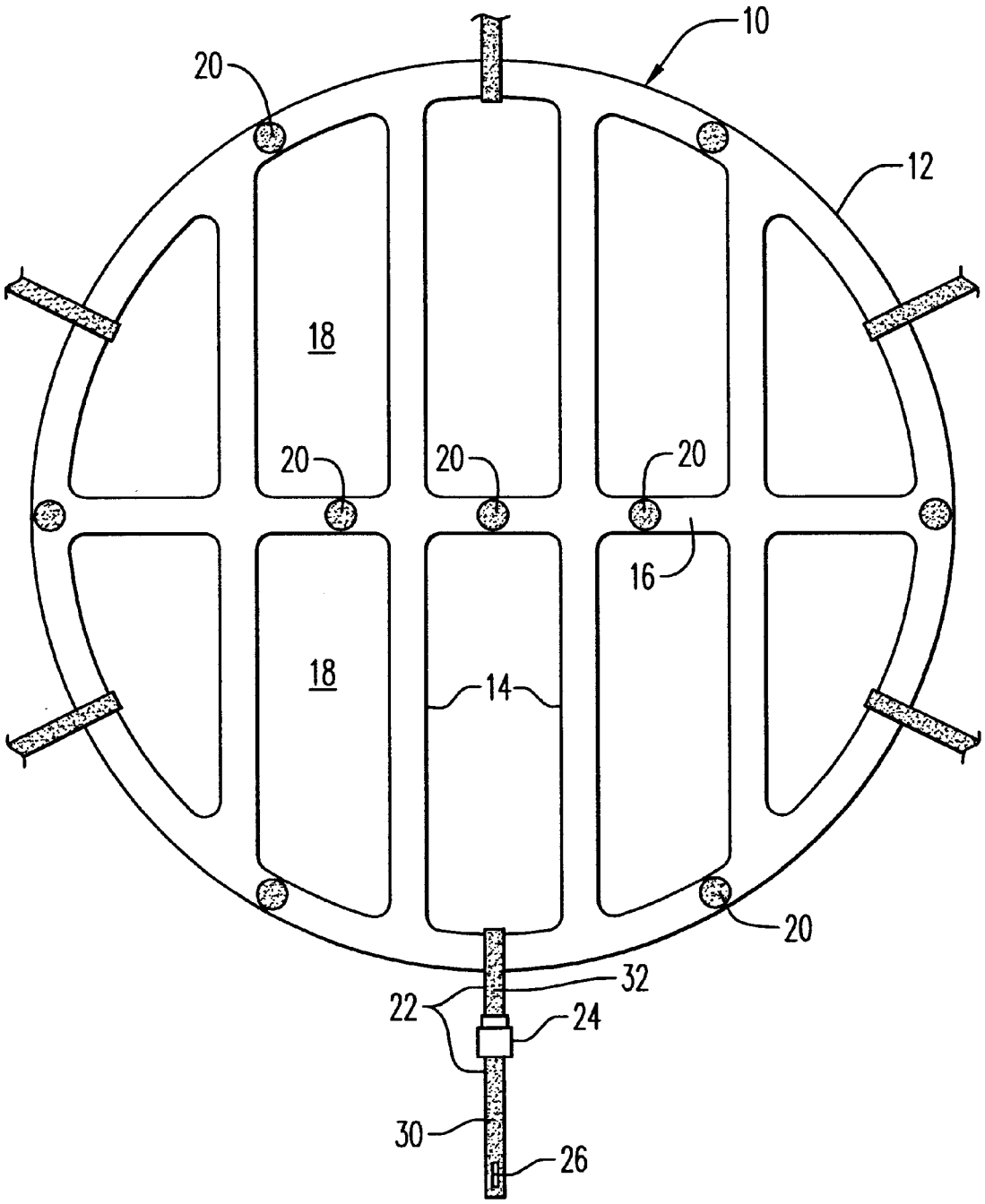
FIG. 2 is a front view of a second embodiment of the present invention.
Figure 3:
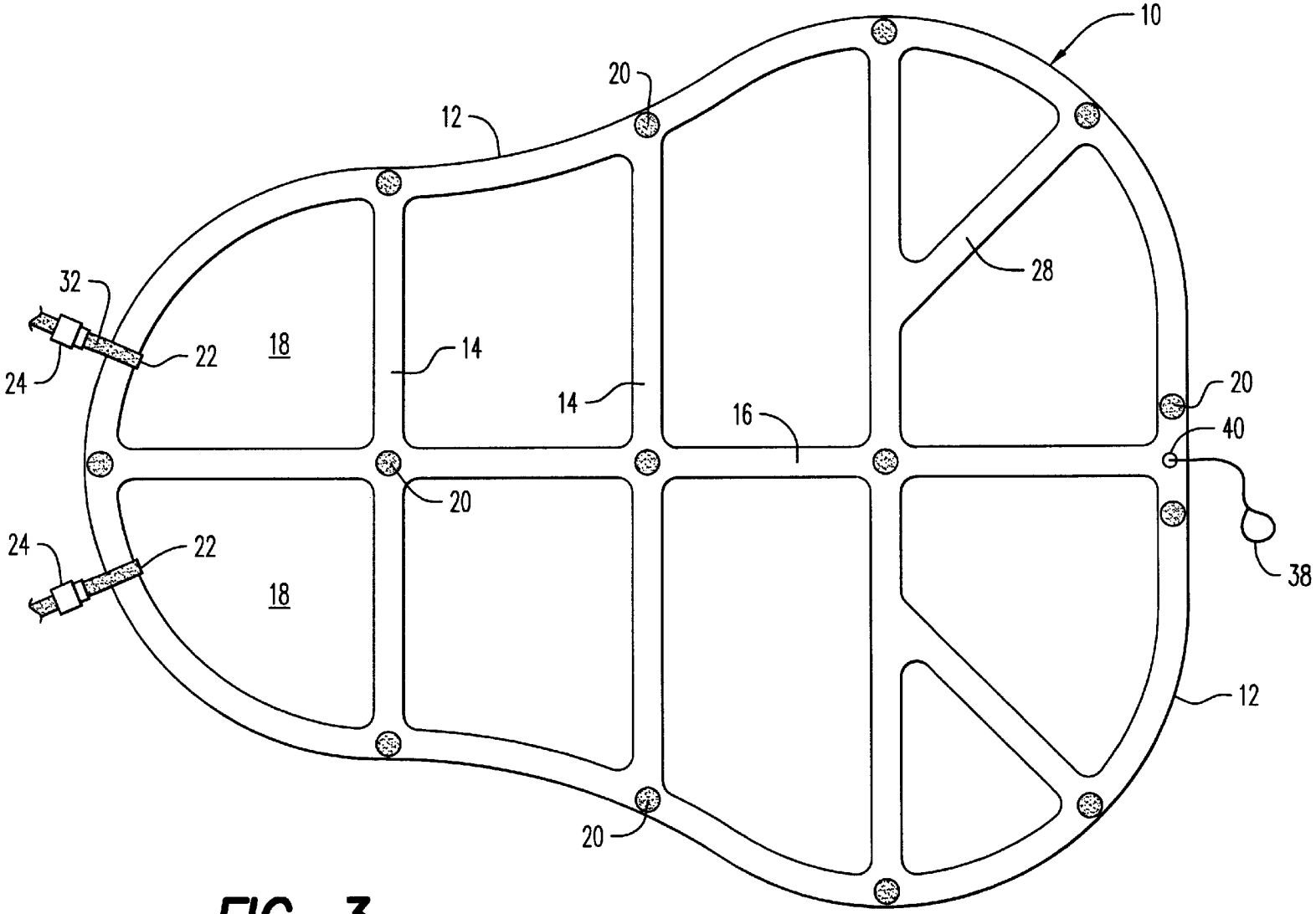
FIG. 3 is a front view of a third embodiment of the present invention.

Referring to the figures, there is provided a device generally represented by reference numeral 10. The device, also called herein a tone device 10, is adapted to be used on various string instruments. As shown in FIGS. 1 and 2, the device 10 has a circular configuration thereby making the device particularly adapted for use in connection with stringed instruments having a circular back, such as, for example, a mandolin or banjo. FIG. 3 depicts a tone device 10 preferably adapted for use with a guitar.

The device 10 has an outer periphery or contour 12 that is shaped to match the approximate contour of the back surface of the stringed instrument to which the device will be mounted. The contour 12 encircles a hollow interior or space. The device 10 has an intersect bar 16 that connects two portions of outer contour 12 to create two spaces 18 of the device 10. If the intersect bar 16 is, preferably, at the diameter of contour 12, it creates two halves or spaces 18. The device 10 also preferably includes a plurality of bars 14 that preferably interconnect with intersect bar 16 to form a plurality of spaces 18.

As shown in the preferred embodiments of FIGS. 1 and 2, the plurality of bars 14 are basically perpendicular to intersect bar 16, and the intersect bar 16 is approximately at the diameter of the contour 12. This arrangement of bars 14,16 is a preferred embodiment of the present invention. It will be apparent to one of ordinary skill in the art that the specific arrangement of bars 14,16 is not critical to the functioning of the tone enhancement or improvement device. Accordingly, a variety of configurations are possible. The bars need not intersect, and can form any angle with the contour 12 of the device 10, and with each other.

The device 10 preferably has a plurality of protective pads 20 affixed to one surface, which surface is adjacent the back of the instrument. In the preferred embodiments shown in FIGS. 1 and 2, the plurality of pads 20 are positioned on the contour 12, and on the intersect bar 16. The pads 20, which prevent the device 10 from scratching the finish of the instrument, cause the device 10 to be lifted slightly above the surface of the instrument. The pads 20 are preferably made of felt, which is a soft material, thereby preventing gouging or marring of the instrument's surface. The pads 20 can be permanently affixed to the device 10, and are usable for an indefinite time period showing little, if any, noticeable effects of wear and tear.

The device 10, which is preferably composed of a single piece of wood, may be carved or machined into a grid-like pattern having integral wooden bars. The wooden device can aesthetically compliment the wood construction of the instrument and has an easily workable surface. In the device of FIG. 1, which is preferably used on a mandolin, and the device of FIG. 2, which is preferably used on a banjo, the contour 12 of the device 10 preferably is about one-quarter inch thick and about one-half inch wide, and the bars 14,16 are preferably about one-quarter inch thick and one-quarter inch wide. In the device of FIG. 3, which is preferably used on a guitar, the contour 12 and bars 14,16 of the device 10 preferably are about one-quarter inch thick and about one-half inch wide. The thickness of the contour and bars is the dimension perpendicular to the back surface of the instrument, and the width of the contour and bars is the dimension parallel to the back surface of the instrument.

The contour 12 should preferably be relatively narrow since the less material that comprises the device 10, the less material there is to potentially muffle or otherwise dampen the sound of the instrument. However the contour 12 should not be so narrow as to compromise the strength of the device 10, or to permit the clothes or body of the player to press directly against instrument over a large surface area. The sharp edges of the contour 12 and bars 14,16 created during production are sanded smooth to minimize the possibility of wood cuts.

Also, the pads 20 are preferably of sufficient height so that the contour 12 and intersect bar 16 are raised away from the back of the instrument, which in turn spaces the back of the instrument further away from the user's body. Accordingly, in the device 10 of FIG. 1, the pads 20 placed on contour 12 are preferably about one-half inch in diameter and about one-half inch thick, while the pads 20 on intersect bar 16 are preferably about one-half inch in diameter and about one-sixteenth inch thick. In the device of FIG. 2, all of the pads 20 are preferably about one-half inch in diameter and about one-eighth inch thick. In the device of FIG. 3, the pads are similarly preferably about one-half inch in diameter and one-eighth inch thick.

In a preferred embodiment, the device 10 is mounted to the instrument by means of a plurality of strap assemblies. Preferably, each strap assembly is a two-piece strap assembly that includes a strap 22 having a snap-release buckle 24 that can be looped over the device 10 and buckled to a second similar strap 22. Felt can be placed on the surfaces of the buckles contacting the instrument to prevent scratching or other abrasions. The straps 22 can be adjustable in order to adjust to the instrument's dimensions, so that one device can fit different instrument body designs, sizes and dimensions within a given range. In a preferred embodiment, the straps 22 can be adjusted by pulling the end of the strap through the snap-lock buckles 24. Once the snap-lock buckles are engaged and the straps are pulled snug, the player is assured that the device is attached securely. The strap 22 can be made of any material, although leather is preferred.

Most preferably, the leather straps 22 are one-quarter inch in width with various lengths between four to sixteen inches, depending upon the instrument's dimensions. Each strap 22 has a three-eighths to one-half inch slit 26 at one end, through which the strap can be threaded to form a circle around the device.

When the device 10 of FIG. 1 is attached to a mandolin, two straps assemblies comprising two straps each can be used. A longer strap 30 bearing the male or female portion of the snap-release buckle 24 at one end, and looped about the device 10 at the other, will encircle a part of the mandolin and buckle into the complementary portion of buckle 24 mounted on a shorter strap 32. The shorter strap 32 is also looped about the device 10, preferably at an offset from the attachment point of the longer strap 30. It is preferred that the longer strap 30 extend from the device 10 (in place against the back of the mandolin), alongside the tail piece of the mandolin, under the strings at the front of the tail piece and then along the other side of the tail piece. The longer strap 30 is then secured to the mating portion of the snap-release buckle 24, which is carried on the shorter strap 32. A second strap assembly is attached to the device 10 towards the neck area of the mandolin. A longer strap 34 passes over the body of the mandolin and under the strings at the end of the fretboard, continues over the other side of the fretboard, and is secured to a shorter strap 36 via snap-release buckle 24.

A slightly different strap configuration is preferred for use with a banjo. For the device 10 as depicted in FIG. 2, approximately six strap assemblies are used, radially arrayed about the device. Each strap 32 is looped about the device 10 as discussed above. Slit 26 of strap 30 functions differently in this embodiment, however. Slit 26 of strap 30 is placed directly over and pressed onto a lug (not shown) located about the banjo head surface. The length of straps 30,32 is then adjusted for proper tension, and the snap-release buckle 24 is buckled to secure the device 10. The strap 30 cannot pass over or make contact with the banjo head surface, as this would result in a dampening effect of the tone and sound volume.

The instrument can even be stored in its case for transportation with the device 10 affixed to it. When desired, the snap-lock buckles 24 are easily released to remove the device 10 from the instrument, and the length of the straps 30,32 can easily be adjusted. This adjustability allows great flexibility of use. For example, the device 10 of FIG. 1 can adjust to cover most style A and F mandolin bodies. The device 10 depicted in FIG. 2 can adjust to fit a variety of resonator style banjos.

When attached to the instrument, the device 10 lies against substantially all of the back surface of the instrument. The spaces 18 allow unmuffled projection of sound. Bars 14,16 separate the back surface of the instrument from direct contact with the player's body and clothes. This substantially improves the quality of the tone produced by the instrument by not impairing or abating the tone otherwise projecting from the instrument, while leaving the player unhindered to move about and to reposition the instrument. It is preferred that the size of spaces 18 be maximized and the surface area covered by contour 12 and bars 14,16 be minimized, without comprising the structural integrity of device 10, so that optimal, unimpeded tone can be produced.

FIG. 3 shows a device 10 having essentially the same characteristics as the device of FIG. 1. However, the device 10 of FIG. 3 has a non-circular contour 12 that is designed to follow the contours of a back surface of an acoustic or acoustic/electric guitar. The device 10 depicted in FIG. 3 is suitable for guitar body styles produced by different manufacturers. Preferably, the device 10 of FIG. 3 is one-half inch wide and one-quarter inch thick. As shown in FIG. 3, bars 14,16 take on a somewhat different configuration, with central bar 16 lying along the lengthwise axis of the device 10, and bars 14 intersecting bar 16 at right angles. Supplemental bars 28 join contour 12 and bars 14 to provide additional strength and integrity to the structure of device 10.

Figure 5:
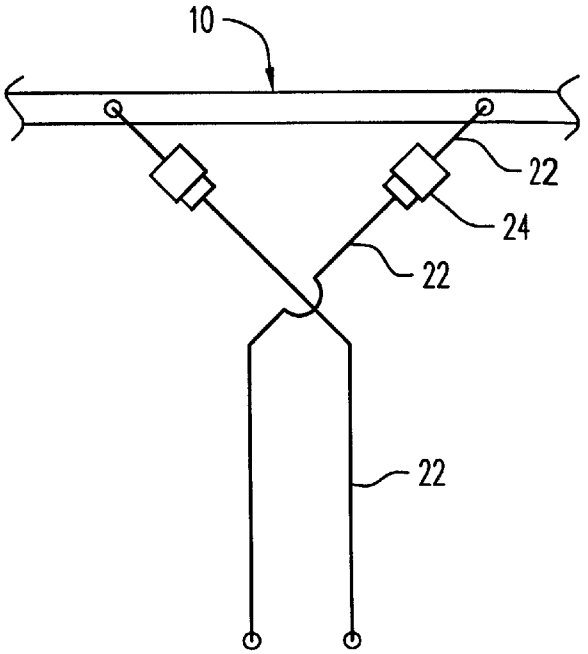
FIG. 5 is a diagram of the strap assembly of the embodiment of FIG. 4.
Figure 4:
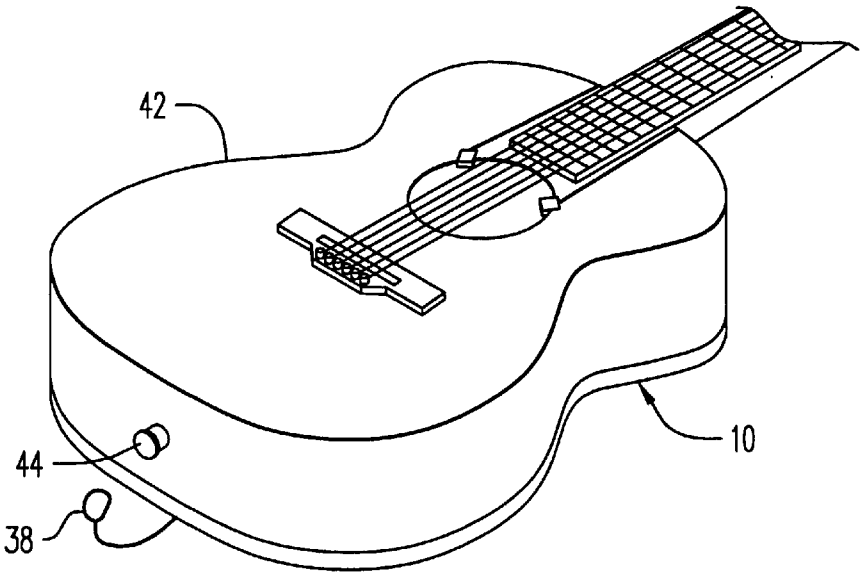
FIG. 4 depicts the device of FIG. 3 mounted on a guitar.

In addition, the device 10 is mounted to the guitar in a unique manner. As depicted in FIGS. 4 and 5, guitar 42 has an end pin 44. The device 10 is placed against the back surface of guitar 42. A loop 38 formed in one end of a piece of nylon cord or small diameter line is placed over the end pin 44 of the guitar 42. The cord preferably (see FIG. 3) is secured directly to the device 10 by threading the cord through a hole 40 (in this embodiment preferably 5/32 inch in diameter) in the device and tying the cord with a common non-slip knot such as a two half-hitch knot. At the other end of the guitar body, a hook with a longer strap 30 attached is placed over the edge of the sound hole on each side of the fretboard. The two longer straps 30 run alongside the fretboard and, at the guitar neck, cross to the other side of the neck, forming the letter "X". Each longer strap 30 then is buckled to a mating shorter strap 32 that is looped about the device 10, as discussed above. The "X" configuration of the straps at the neck prevents the device from shifting.

Every player holds the instrument differently. The device 10 of the present invention, not the player, accommodates the player's playing style, posture, or manner of holding the instrument, whether the player is standing or sitting. Since the device 10 follows the outline of the instrument and provides full, not partial, coverage of the instrument back, any normal playing position is possible and the tone is fully resonated. In addition, the wood construction has some flexibility to conform to the contour and body arch of the instrument. The dampening effect resulting from body contact between the player and the instrument is minimized or eliminated. Accordingly, the resonance, tone quality, and sound volume are all greatly enhanced.

Various modifications may be made as will be apparent to those skilled in the art. For example, the device 10 can be constructed of other suitable materials, including plastic. Different styles of straps or attachments known in the art can be used to attach the device 10 to the instrument. The pads 20 may be discrete or continuous, and may be located in a variety of configurations. Alternately, the device 10 may be coated with a protective covering.

In addition, configurations other than parallel and intersecting bars may be employed. For example, multiple circular or other holes may be formed in a sheet of material formed to follow the contours of the instrument. The size and spacing of the holes could be varied to control the strength of the device 10 and the tone flow therethrough. This would form a "polka dot" style device providing the same benefits as the preferred embodiments disclosed above. Furthermore, the device 10 could be constructed of multiple parts ultimately joined into an integral whole. The device 10 could also be constructed as a loop, that is, as a device having only one aperture. This design, while less than optimal, would also function to improve tonal quality.

Thus, it will be obvious to one of ordinary skill in the art that the foregoing description and drawings are merely illustrative of certain preferred embodiments of the present invention, and that various obvious modifications can be made to these embodiments in accordance with the spirit and scope of the appended claims.

What is claimed is:

1. A device for attachment to the back surface of a stringed instrument that can be played against the body of a player, the device spacing the instrument from the body to avoid dampening of sound otherwise caused by the body, thereby permitting truer tone transmission, said device comprising:

a plate having an outer contour approximately matching an outer contour of said back surface of the instrument; and at least one space through said plate.

2. The device of claim 1, further comprising means for removably attaching said plate to the back surface of the instrument.

3. The device of claim 1, wherein said attachment means are adjustable.

4. The device of claim 1, wherein said plate has a first surface for attachment to said back surface, and wherein cushioning means is disposed on said first surface for spacing said first surface from said back surface.

5. The device of claim 4, wherein said cushioning means comprises a plurality of pads.

6. The device of claim 5, wherein said plurality of ads are made of felt.

7. A device for positively affecting a tone emitted from a stringed instrument, comprising:

a flat wooden plate having at least two spaces therethrough, said plate having a periphery defining an outer rim similar in shape to a back surface of the instrument; and a median bar extending inwardly from said outer rim.

8. The device of claim 7, wherein said median bar extends across a diameter of said plate.

9. The device of claim 7, further comprising at least one strap for mounting said plate on the instrument.

10. The device of claim 8, wherein said plate has a first surface for attachment to said back surface, and wherein cushioning means is disposed on said first surface for spacing said first surface from said back surface.

11. The device of claim 7, further comprising a plurality of bars.

12. The device of claim 11, wherein said plurality of bars are substantially parallel bars intersecting said median bar.

13. The device of claim 12, wherein said parallel bars form right angles with said median bar.

14. The device of claim 12, wherein said parallel bars are substantially equally spaced one from another.

15. The device of claim 12, wherein said outer rim has a substantially circular shape.

16. The device of claim 12, wherein said outer rim is shaped substantially in the form of a letter "C" facing and smoothly connected to a sideways letter "U".

17. The device of claim 16, wherein said outer rim is shaped substantially to conform to a back surface of a guitar.

18. The device of claim 16, wherein said median bar connects a centerpoint of said letter "C" to a centerpoint of said letter "U", and further comprising supporting integral bars extending from said outer rim to a point on one of said parallel bars intermediate said outer rim and said median bar.

19. The device of claim 7, wherein said median bar is integral to said plate.

20. The device of claim 11, wherein said plurality of bars are integral to said plate.

21. The device of claim 8, wherein said cushioning means comprises a plurality of pads for spacing said plate from the instrument.

* * * * *